United States Patent [19]

David

[11] 3,979,039

[45] Sept. 7, 1976

[54] BLIND RIVET APPARATUS

[76] Inventor: Melvin J. David, 16221 Quemada Rd., Encino, Calif. 91316

[22] Filed: June 21, 1974

[21] Appl. No.: 481,502

Related U.S. Application Data

[62] Division of Ser. No. 307,442, Nov. 17, 1972, abandoned.

[52] U.S. Cl. ..... 227/60

[51] Int. Cl.[2] ..... B21J 15/36

[58] Field of Search ..... 227/51, 52, 53, 54, 227/55, 56, 57, 58, 59, 60, 61; 29/243.52, 243.53, 243.54; 72/391

[56] References Cited

UNITED STATES PATENTS

| | | | |
|---|---|---|---|
| 1,271,720 | 7/1918 | Kenway | 227/53 |
| 2,405,399 | 8/1946 | Bugg et al. | 29/243.52 |
| 3,009,598 | 11/1961 | Tibbetts | 72/391 |
| 3,030,849 | 4/1962 | Bisbing et al. | 227/52 X |
| 3,442,112 | 5/1969 | Abromauage | 72/391 |

*Primary Examiner*—Granville Y. Custer, Jr.

[57] ABSTRACT

A blind rivet assembly and tool for inserting same for facilitating blind riveting processes. A carrier element having a removably secured blind rivet body provides for improved automatic insertion techniques. A carrier element has the blind rivet bodies uniformly disposed along the longitudinal dimension thereof. The rivet body is adapted for insertion within a given workpiece without the need for an integral pulling stem or mandrel. The insertion tool cooperatively engages an end portion of the rivet body forming the rivet head.

6 Claims, 11 Drawing Figures

Fig. 1
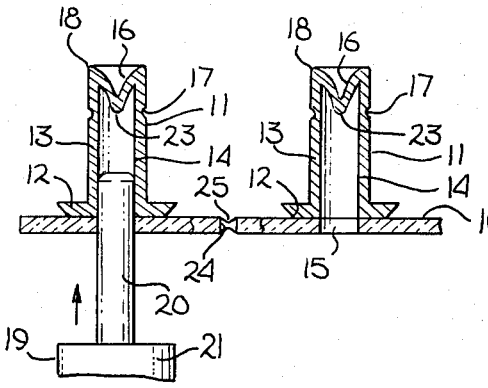
Fig. 2
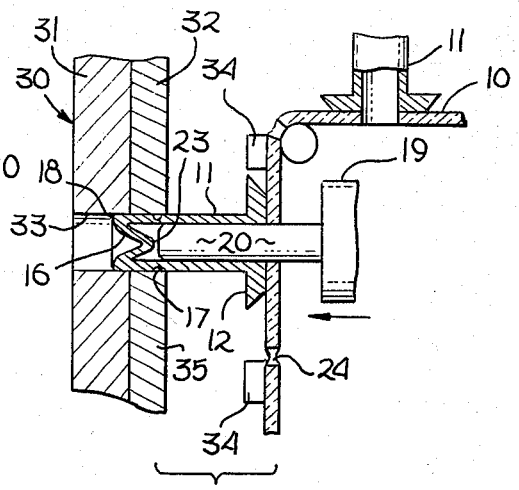
Fig. 3
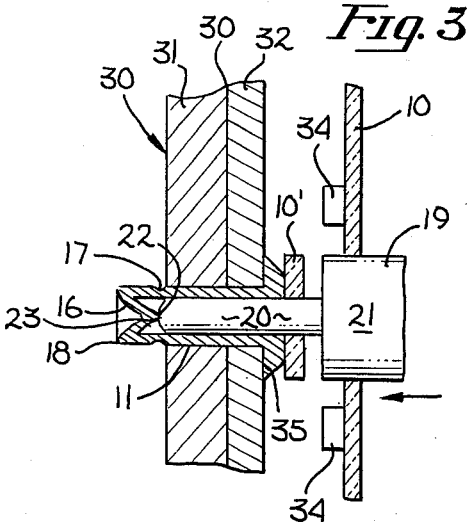
Fig. 4
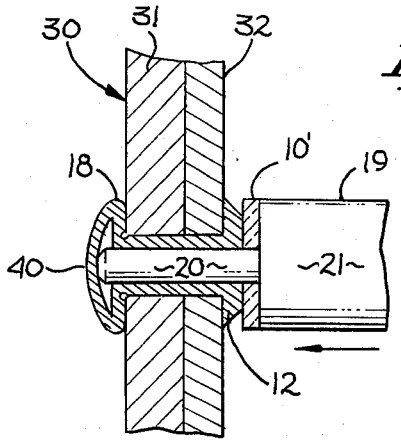
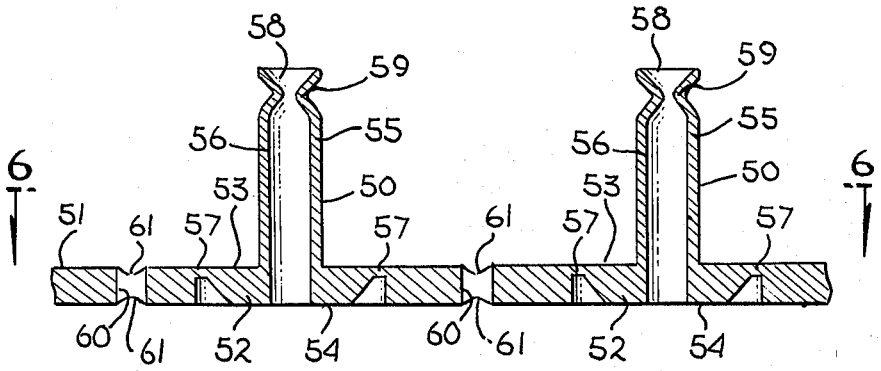
Fig. 5

Fig. 6
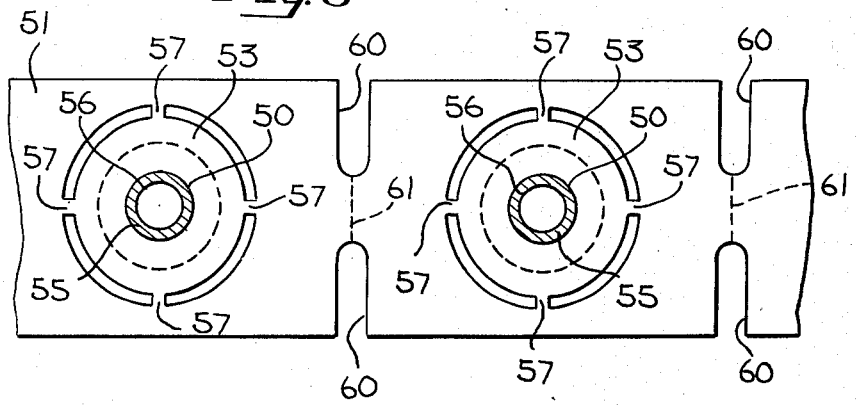
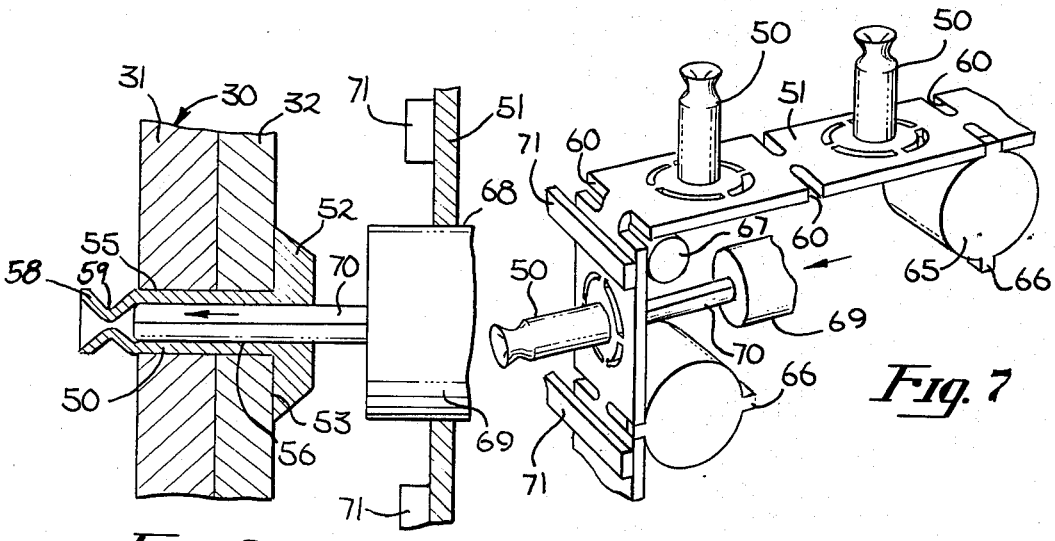
Fig. 7
Fig. 8
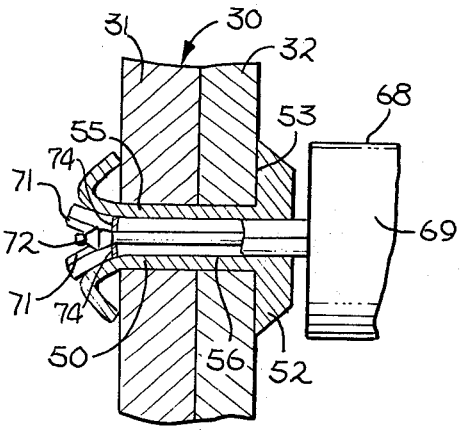
Fig. 9
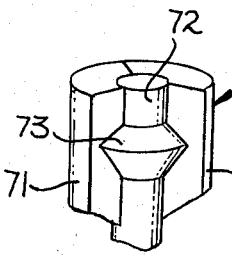
Fig. 10
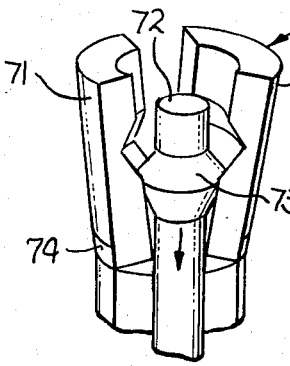
Fig. 11

BLIND RIVET APPARATUS

This is a divisional application of my copending application Ser. No. 307,442 filed Nov. 17, 1972, now abandoned.

BACKGROUND OF THE INVENTION

1. Field of the Invention

The present invention generally relates to structures used in blind riveting apparatus and, in particular, those apparatus adapted for automatic insertion techniques.

2. Prior Art

There are many devices disclosed in the prior art which are generically described as blind rivets. The typical blind rivet disclosed in the prior art utilizes a hollow metal rivet member having a preformed rivet head at one end thereof. A pulling stem or mandrel member of metal being able to withstand higher axial stress than the material of the rivet is also provided, the mandrel being sized to pass through the interior of the hollow rivet. The mandrel has a rivet forming head which is adapted to be cooperatively engaged with the portion of the rivet member opposite the preformed rivet head. By pulling the mandrel through the rivet, the portion of the rivet body in contact with the rivet forming head of the mandrel is forced back thereby producing a rivet head which typically binds a pair of overlapping members into an integral assembly.

The devices disclosed by the prior art typically have one characteristic in common, that being the need for a pulling stem or mandrel to form a rivet head opposite the preformed rivet head of the rivet body. The mandrel used by these devices may differ in shape and content, but all typically provide the force needed to deform the malleable material of the rivet body into a formable rivet head.

Another feature which is typically represented by the devices disclosed in the prior art is the individual nature of the rivet assembly as opposed to a structure which is adapted for automatic insertion techniques. The devices disclosed in the prior art comprise a rivet body having a cooperating mandrel or pulling stem disposed therethrough, the combination of elements comprising the blind rivet and mandrel being adapted only for manual insertion within a workpiece and formation of the rivet head thereafter.

The problems which remain inherent in the devices disclosed by the prior art center on the required use of a pulling stem or mandrel as well as the inability of the prior art devices to be easily used with automatic insertion equipment. The present invention substantially resolves the problems which have heretofore remained unsolved by the devices disclosed in the prior art.

The present invention comprises a blind rivet apparatus which requires no mandrel or pulling stem and the insertion tool for use with same. The structure of the present invention comprises a carrier element in combination with rivet bodies which are uniformly disposed along the longitudinal dimension of the carrier element. The carrier element and integral rivet body are adapted to be used with an insertion tool which is typically a portion of automatic insertion apparatus. In all forms of the present invention, the insertion apparatus used for separating the rivet body from the carrier element causes formation of the rivet head from the rivet body itself. In this manner, rivet bodies may be properly oriented and registered with respect to a given workpiece and be disposed within and formed into a rivet without the requirements of those devices disclosed in the prior art. In this manner, a blind rivet apparatus is adaptable for automatic insertion techniques, the device eliminating the wasteful and costly need for a pulling stem or mandrel as required by the devices disclosed in the prior art.

Summary of the Invention

The present invention comprises a blind rivet apparatus which is adaptable for use with automatic insertion devices as well as providing a structure which is substantially simpler than those disclosed in the prior art. A carrier element has disposed along the longitudinal dimension thereof a plurality of uniformly spaced rivet bodies, the preformed rivet head being adjacent the carrier element. The preformed rivet head is extended into a tubular body having a uniform inner and outer diameter, the end of the tubular body opposite the preformed rivet head being adapted to be formed into the formable rivet head. The rivet body is constructed of a malleable material such that the imposition of force axially directed along the inner diameter of the rivet body will cause the end thereof to be formed into a rivet head locking the rivet body in place.

The carrier element and disposed rivet body are used in combination with insertion apparatus which provides a dual function. The insertion apparatus has a projection element which serves the same function as the pulling stem or mandrel of the prior art devices. In addition, the insertion tool serves to separate the rivet body from the carrier element. The insertion apparatus is disposed through the preformed rivet head and slidably engaged with inner aperture of the rivet body. Mechanical or hydraulic force is directed through the insertion apparatus along the axis of the inner diameter of the rivet body, the insertion apparatus cooperatively engaging projections from the end of the rivet body opposite the preformed rivet head. The cooperative engagement between the insertion apparatus and the rivet body causes the formation of a rivet head locking the present invention within the subject workpiece.

It is therefore an object of the present invention to provide an improved blind rivet apparatus.

It is still another object of the present invention to provide a blind rivet apparatus which does not use an integral mandrel or pulling stem.

It is yet another object of the present invention to provide a blind rivet apparatus which is adaptable for use with automatic insertion equipment.

It is still yet another object of the present invention to provide a blind rivet apparatus which is inexpensive and simple to fabricate.

The novel features which are believed to be characteristic of the invention, both as to its organization and method of operation, together with further objectives and advantages thereof will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

BRIEF DESCRIPTION OF THE DRAWING

FIG. 1 is a side elevation, partial cross-sectional view of a form of the blind rivet apparatus and insertion tool in accordance with the present invention.

FIG. 2 is a side elevation, partial cross-sectional view of a form of the present invention being disposed within a workpiece.

FIG. 3 illustrates an enlarged, partial cross-sectional view of a rivet body inserted within a workpiece preparatory to the formation of the rivet head in accordance with the present invention.

FIg. 4 is a blind rivet formed in accordance with the present invention.

FIG. 5 is a cross-sectional view of another form of a blind rivet apparatus in accordance with the present invention.

FIG. 6 is a top plan view of the blind rivet apparatus of FIG. 5 taken through line 6—6 of FIG. 5.

FIG. 7 is a perspective, schematic view of the form of the present invention shown in FIG. 5 incorporated upon automatic insertion equipment.

FIG. 8 is a partial, cross-sectional view illustrating the insertion of a blind rivet in accordance with the form of the present invention shown in FIG. 7.

FIG. 9 illustrates the formation of the rivet head in accordance with the form of the present invention shown in FIG. 7.

FIG. 10 is a sectioned view of the insertion tool shown in FIG. 7.

FIG. 11 is a sectioned view of the insertion tool shown in FIG. 8 illustrated in the extended position.

DESCRIPTION OF THE PRESENTLY PREFERRED EMBODIMENTS

An understanding of the present invention can be best gained by reference to FIG. 1 wherein a side elevation, cross-sectional view of the blind rivets and insertion elements are illustrated. Carrier element 10 comprises a strip of flexible material having a predetermined transverse width and an undetermined longitudinal length. Carrier element 10 is typically fabricated of paper, cardboard or other easily breakable or deformable material. The structural requirements for carrier element 10 will be discussed in detail hereinbelow. Rivet bodies 11 are uniformly disposed along the longitudinal dimension of carrier element 10. The longitudinal dimension is sufficiently long to provide for receiving a plurality of rivet bodies 11 to fully utilize the automatic insertion capabilities of the present invention.

Rivet body 11 comprises preformed rivet head 12 which is removably secured to a surface of carrier element 10. Preformed rivet head 12 is typically secured to carrier element 10 by conventional adhesive material. Preformed rivet head 12 is integral with and concentric to cylindrical member 13. Cylindrical member 13 has a uniform inner and outer diameter, inner diameter 14 being extended through preformed rivet head 12. Carrier element 10 has a plurality of apertures disposed along the longitudinal dimension thereof, apertures 15 being in substantial alignment with inner diameter 14 of each rivet body 11.

The portion of cylindrical member 13 axially opposite preformed rivet head 12 comprises the element necessary for forming the rivet head of the present invention blind rivet apparatus. Cylindrical member 13 is closed by concave, tapered end 16, tapered end 16 having an inner and outer surface contiguous with the inner and outer diameter respectively of cylindrical member 13. As can be seen in FIG. 1, the outer surface of cylindrical member 13 has circumferentially disposed thereabout annular groove 17. Annular groove 17 is adapted to be substantially adjacent the exposed surface of a workpiece after cylindrical member 13 has been inserted preparatory to the formation of the rivet head. Annular groove 17 will provide a fulcrum about which circumferential lobe 18 will pivot during the insertion process. This will be explained in greater detail below.

The formation of a blind rivet with the use of the form of the present invention shown in FIG. 1 utilizes an insertion apparatus which is capable of applying mechanical, hydraulic or pneumatic force along the axis of cylindrical member 13. An exemplary tool to apply mechanical force is insertion tool 19 comprising rivet forming stem 20 and base 21. Rivet forming stem 20 is adapted to be slidably inserted within inner diameter 14 of cylindrical member 13, contacting surface 22 being adapted to be received by apex 23 of tapered end 16. Base 21 has a diameter which is substantially equivalent to the diameter of preformed rivet head 12. As rivet forming stem 20 is axially moved into inner diameter 14, base 21 will sever carrier element 10 in alignment with preformed rivet heat 12 and result in the removal of the rivet body 11 being inserted from the remainder of carrier element 10. As stated, the form of the present invention shown in FIG. 1 requires the application of axial force for the formation of a rivet head at tapered end 16, the description of specific insertion tool 19 being for the purpose of illustration only.

As previously stated, an object of the present invention is to provide an improved blind rivet apparatus which can be used with automatic insertion equipment. To permit flexibility in the angle of insertion and other mechanical requirements necessary for automatic insertion, indentations 24 are transversely disposed in the side surfaces of carrier element 10 intersticial with the placement of rivet bodies 11. Indentations 24 allow carrier element 10 to bend or otherwise change its direction of movement such as shown in FIG. 2. Although FIG. 1 illustrates only a single transverse edge of carrier element 10, it is understood that an indentation 24 may be disposed in the transverse edge opposite to that shown, the indentations 24 being transversely aligned with one another. To add flexibility to carrier element 10, perforations 25 can be disposed intermediate the aligned indentations 24 to allow planar flexibility and thereby permit the rivet body 11 being inserted to be positioned in a plane different from that of the remainder of carrier element 10. Perforations 25 merely reduce the force necessary to deflect carrier strip 10 in between each rivet head 12.

The insertion of a blind rivet in accordance with the invention shown in FIG. 1 can be best seen by reference to FIGS. 2, 3 and 4. It is to be noted that workpiece 30 is disposed adjacent bracing elements 34, spacing between surfaces 35 and elements 34 shown in FIG. 2 being for illustration only. As stated previously, one of the deficient features of the devices disclosed in the prior art was the requirement that a disposable mandrel or pulling stem be removably inserted within the rivet body, and after formation of the rivet, the pulling stem or mandrel would be disposed of. This requires the added expense of manufacturing an element which is going to ultimately be thrown away as well as requiring insertion equipment which must be capable of gripping or otherwise affixing itself to the pulling stem or mandrel. FIGS. 2, 3 and 4 illustrate the insertion process of the form of the present invention shown in FIG. 1. As can be seen, no disposable mandrel is required, the exemplary insertion tool 19 providing all necessary axial force for the formation of a blind rivet.

Referring now to FIG. 2, the set-up procedure for the insertion and formation of a blind rivet in accordance with the present invention is shown. Workpiece 30 comprises a pair of elements 31 and 32 which are to be joined together. FIG. 2 illustrates merely an exemplary method by which rivet body 11 can be positioned or otherwise registered for insertion within workpiece 30. The structure of the equipment used to insert and withdraw forming stem 20 is beyond the scope of this application, the pertinent structure being defined by the relationship between forming stem 20 and tapered end 16. Carrier element 10 is positioned or otherwise registered through the use of indentations 24, a rivet body 11 being aligned with orifice 33 through elements 31 and 32 of workpiece 30. The longitudinal distance between indentations 24 is the same as the distance between bracking elements 34 (FIG. 2) thereby providing for necessary registration information. The automatic insertion equipment being used with the form of the present invention shown in FIG. 2 utilizes a pair of bracing elements 34 in the same plane as preformed rivet head 12. Bracing elements 34 will permit the imposition of force by base 21 of insertion tool 19 on carrier element 10 without deleteriously affecting the alignment of carrier element 10. The axial length of cylindrical member 13 is typically adapted for the thickness of workpiece 30. In this manner, the distance between surface 35 of preformed rivet head 12 and annular groove 17 is typically the thickness of workpiece 30. This will allow proper movement of tapered end 16 when the force of insertion tool 19 is imposed thereon.

After rivet body 11 is manually inserted into orifice 33 typically by placement of workpiece 30 thereon, rivet forming stem 20 is inserted into aperture 15 of carrier element 10 and the contiguous inner diameter 14 of cylindrical member 13. Axial movement of insertion tool 19 is schematically depicted in FIG. 2 and is shown positioned preparatory to the formation of the rivet head at tapered end 16. As mentioned previously, the axial force to be imposed upon tapered end 16 could be by hydraulic rather than mechanical as exemplified by insertion tool 19.

The insertion of rivet body 11 preparatory to the formation of the formable rivet head can be best understood by reference to FIG. 3. Insertion tool 19 is typically a dual action member, base 21 moving in a cooperative relationship to rivet forming stem 20. The dual action of tool 16 comprises the formation of the formable rivet head and the removal of pre-formed rivet head 12 from carrier element 10. Base 21 moves against the bottom surface of carrier element 10 after insertion stem 20 has been disposed within inner diameter 14. This will insure alignment of rivet body 11. By the use of cam positioning controls which are well known to persons having skill in the art, base 21 moves against carrier element 10 to remove carrier element portion 10′ from the remainder of the carrier element 10, after which insertion stem 20 is axially moved through base 21 to place surface 35 of preformed rivet head 12 adjacent the surface of element 32 of workpiece 30. The cam controls to be utilized can be selected from conventional assemblies such as a slot cam. Base 21 can move through carrier element 10 to remove carrier element portion 10′ by the opposing force imposed by bracing elements 34.

The position of rivet body 11 immediately prior to the formation of the rivet head is shown in FIG. 3. Contacting surface 22 is adjacent apex 23 of tapered end 16. In addition, since the distance between surface 35 and annular groove 17 is selected for the thickness of workpiece 30, annular groove 17 will substantially be adjacent the surface of workpiece element 31.

The result of imposing an axial force through insertion stem 20 can be best seen by reference to FIG. 4. Rivet body 11 is typically fabricated from a malleable and readily formable material such as aluminum alloys. By imposing an axial force through insertion stem 20 sufficient to deform the malleable material from which rivet body 11 is constructed, a blind rivet head 40 such as shown in FIG. 4 is formed. The imposition of axial force through insertion element 20 on tapered end 16 transfers the force along the tapered surface of end 16 to circumferential lobes 18. Since the force imposed on circumferential lobe 18 has a component directed radially outward, circumferential lobe 18 will pivot about annular groove 17 thereby forming blind rivet head 40. Since carrier element portion 10′ is removably secured to preformed rivet head 12, after removal of insertion tool 19 as shown in FIG. 4, carrier element portion 10′ can itself be removed leaving the blind rivet as shown disposed within workpiece 30.

An understanding of another form of the present invention can be best gained by reference to FIG. 5 wherein an enlarged, side elevation cross-sectional view is shown. In the form of the present invention illustrated in FIG. 5 and FIG. 6, rivet bodies 50 are directly formed from the material making up carrier element 51. In this case, carrier element 51 is constructed from a malleable and readily formable material such as aluminum alloys in order to provide sufficient flexibility in the use of the present invention blind rivet apparatus as well as providing the structural sturdiness necessary to form and maintain a suitable rivet. In the form of the present invention shown in FIG. 5 and FIG. 6, preformed rivet head 52 has top and bottom surfaces 53 and 54 respectively which are coplanar with the respective surfaces of carrier element 51. In the form of the present invention shown in FIG. 5 and FIG. 6, surface 53 of preformed rivet head 52 will be placed in abuttment with the applicable workpiece.

The formation of rivet bodies 50 utilizes conventional drawing processes whereby cylindrical member 55 is drawn from the material of carrier element 51. Using conventional process steps, cylindrical member 55 will be sequentially drawn to the appropriate inner and outer diameters after which cylindrical body 55 will be trimmed to the proper length. By utilizing conventional drawing processes, cylindrical body 55 is integral with preformed rivet head 52 in a manner whereby inner diameter 56 is extended through preformed rivet head 52 to surface 54.

Preformed rivet head 52 is machined so that it is removably secured within the remaining material of carrier element 51. The form of the present invention shown in FIG. 5 and FIG. 6 illustrates the use of a number of remaining bridging elements 57 between carrier element 51 and the machined preformed rivet head 52. Although the form of the present invention shown in FIG. 5 and FIG. 6 utilizes bridging elements 57, this manner of removably securing preformed rivet head 52 to a remaining portion of carrier element 51 is for the purpose of illustration and description only. The manner of machining preformed rivet head 52 and its coupling to carrier element 51 can utilize other conventional machining steps which are well known to persons having skill in the machining art.

As stated, an object of the present invention is to provide a blind rivet apparatus which does not require the use of a disposable mandrel or pulling stem. Referring to FIG. 5 and FIG. 6, the end of cylindrical member 55 axially opposite preformed rivet head 52 is formed into a rivet forming end 58 such as shown in FIG. 5. Rivet forming end 58 is typically in the form of a hyperboloid, the surface of cylindrical member 55 being radially reduced to its minimum diameter at point 59, the surface being radially extended from point 59 to the end of cylindrical member 55.

To provide for flexibility in the use of carrier element 51, registration indicia or indentations 60 are disposed in the transverse edges of carrier element 51 in opposition to one another. The function of registration indicia 50 in addition to providing flexibility and ease of movement for carrier element 51 also provides means whereby each rivet body 50 can be properly aligned and registered for the particular workpiece as was shown to be necessary in FIGS. 2, 3 and 4 discussed hereinabove. To provide additional flexibility, perforations 61 can be disposed in the remaining portion of carrier element 51 interposed between the aligned registration indicia 60. This will insure carrier element 51 can be pivoted or otherwise deflected in a manner which will permit appropriate positioning and registration of rivet body 50 for the blind riveting process.

Referring now to FIG. 7, an understanding of the cooperative relationship between the form of the present invention shown in FIG. 5 and FIG. 6 and illustrative automatic insertion equipment can be best seen. Carrier element 51 is shown being moved along by a pair of typical registration gears 65, registration gears 65 being provided with a pair of diametrically opposed pawls adapted to be received by registration indicia 60. It is to be noted that registration indicia 60 have the dual function of providing flexibility to carrier element 51 as well as providing means for registering the position of rivet body 50. The cooperative relationship between registration gears 65 can utilize one or both of registration indicia 60 as shown in FIG. 7 or utilize a carrier element 51 having only a single registration indicia properly disposed between rivet body 50. Carrier element 51 is shown being deflected about roller 67. The size of roller 67 is for illustration only, the diameter of roller 67 is selected to be consistent with the thickness of carrier element 51. The deflection of carrier element 51 will typically be required for positioning a rivet body 50 for insertion within a subject workpiece. The provision of registration indicia 60 and perforations 61 (FIG. 6) provide the needed flexibility to carrier element 51 to accomplish this objective.

After positioning rivet body 50 for insertion, an insertion tool 68 adapted to be received by rivet body 50 is put in motion in the position shown in FIG. 7. An insertion tool utilized by the form of the present invention shown in FIG. 5 and FIG. 6 will be described in detail below for the purpose of illustration. The interaction between insertion tool 68 and registration gear 65 is conventional and is well known to persons having skill in the art. Insertion tool 68 is not moved in the position shown until registration gear 65 properly orients and registers the next rivet body 50 in the position shown in FIG. 7. The structure of the equipment to be used to synchronize the rotation of gears 65 and tool 68 is beyond the scope of the present application and is not considered as part of the present invention.

The insertion and formation of a blind rivet in accordance with the form of the present invention shown in FIG. 5 and FIG. 6 can be best seen by reference to FIGS. 8 – 11. In the form of the present invention shown in FIG. 5 and FIG. 6, preformed rivet head 52 will be detached from the remainder of carrier element 51 by the imposition of axial force thereon. Referring now to FIG. 8, the insertion of rivet body 50 within workpiece 30 for the purpose of forming a blind rivet can be best seen. An orifice is disposed through workpiece elements 31 and 32 for the purpose of receiving cylindrical members 55 of rivet body 50. Insertion tool 68 comprises base 69 which is used to detach preformed rivet head 52 from the remainder of carrier element 51 and forming stem 70 which is used to form the blind rivet head. Base 69 and forming stem 70 of insertion tool 68 operate in a cooperative relationship with one another in a manner which is well understood by persons having skill in the machining art. Base 69 is cylindrical in shape having an outside diameter consistent with preformed rivet head 52. After cylindrical member 55 is partially disposed within the orifice through workpiece 30, and after forming stem 70 is inserted within inner diameter 56 of cylindrical member 50 for the purpose of aligning rivet body 50, base 69 severs bridging element 57 thereby detaching preformed rivet head 52 from the remainder of carrier element 51. As with the case of that described in connection with FIG. 2, bracing elements 71 maintain the position of carrier element 51 during the insertion process.

A typical forming stem 70 used in connection with the form of the present invention shown in FIG. 5 and FIG. 6 can be best seen by reference to FIG. 10 and FIG. 11. Forming stem 70 is a conventional machine tool used to provide an axial mechanical force which is dependent on the direction of application. Referring to FIG. 10, a cut-away view of forming stem 70 is shown. Forming stem 70 comprises a number of outer elements 71 having a cylindrical profile adapted to be received within inner diameter 56 of rivet body 50. Forming stem 70 is shown to have three outer elements of which only two are shown. It is obvious that a greater or lesser number of outer elements 71 could be used subject to the remaining requirements of forming stem 70. As shown in FIG. 10, three outer elements 71 are employed, each forming one-third, i.e., 120° of the total cylindrical shape of forming stem 70. The interior portions of outer element 71 form a cavity which is adapted to receive mandrel 72, the interior cavity of outer element 71 when joined form a rigid structure with mandrel 72 when in the position shown in FIG. 10. Mandrel 72 is a substantially cylindrical member having an enlarged portion 73 adapted to bear upon the mating surfaces of the inner cavity of outer elements 71. The configuration of forming stem 70 shown in FIG. 10 is maintained when insertion tool 68 is being moved in the direction shown in FIG. 7 and FIG. 8. Outer elements 71 are hinged or otherwise pivotable about the hinge axis 74 thereof (FIG. 9), outer elements 71 being pivoted when mandrel 72 is moved in the direction shown in FIG. 11. When mandrel 72 is moved with respect to stationary outer elements 71 as shown in FIG. 11, enlarged member 73 bears upon the interior cavity surfaces of outer elements 71 causing outer elements 71 to be radially pivoted and adapting the outer surface of outer element 71 to impose an axial force upon the receiving surface of rivet forming end 58, the force being directed in the same direction as that shown for mandrel 72 in FIG. 11.

Referring again to FIG. 8 and FIG. 9, the formation of a rivet head utilizing the form of the present invention shown in FIG. 5 and FIG. 6 can be best understood. In FIG. 8, rivet body 50 is fully inserted through workpiece 30, surface 53 being adjacent workpiece element 32. Rivet body 50 is typically selected to be consistent with the thickness of workpiece 30 such that rivet forming end 58 is fully exposed from workpiece 30. After preformed rivet head 52 is severed from the remainder of carrier element 51 as shown in FIG. 8, forming stem 70 is axially directed through inner diameter 56 of cylindrical member 55 to bear against rivet forming end 58. Since rivet body 50 is formed of a malleable and readily formable material, the axial force imposed by forming stem 70 will cause rivet forming end 58 to be forced radially outwardly beyond the confines of the orifice through workpiece 30. So long as insertion tool 68 is moving in the direction shown in FIG. 8, forming stem 70 will maintain the configuration shown in FIG. 10. To fully form a blind rivet head, mandrel 72 is moved as directed in FIG. 9. By withdrawing mandrel 72 as shown in FIG. 11, the outer surface of outer element 71 will bear upon the exposed hyberbolic surface of rivet forming end 58 causing same to be secured at the surface of workpiece element 31. After the blind rivet is fully formed, mandrel 72 can be properly positioned to withdraw forming stem 70. Carrier element 51 can be provided with rivet bodies 50 which incorporate a closed rivet forming end 40 similar to that discussed in connection with FIGS. 1 – 4. Where a rivet forming end 40 is combined with the rivet bodies 50 used on carrier element, hydraulic or pneumatic force may be used to form the rivet head in place of the mechanical force imposed by insertion tool 68.

The present invention provides an improved blind rivet apparatus which does not require the use of a disposable mandrel or pulling stem and is highly adapted for use with automatic insertion equipment. The rivet bodies used for forming the blind rivet are carried on a carrier element which can be registered and properly oriented for blind rivet insertion. In addition, the insertion tool used for forming the blind rivet head fully adopts the function of the heretofore used disposable mandrel and therefore is economical and simple to fabricate.

I claim:

1. A blind rivet and insertion tool for use with a blind rivet assembly which has a preformed rivet head having top and bottom surfaces, a cylindrical member having a uniform inner and outer diameter integral with and depending from said preformed rivet head, said preformed rivet head having an aperture therethrough coextensive with the inner diameter of said cylindrical member, a rivet head forming end integral with said bylindrical member and in axial opposition to said preformed rivet head, said preformed rivet head comprising first and second portions, the diameter of said first portion being reduced along the axis thereof, said first portion depending into said second portion, said second portion having a continually increasing diameter along the axis thereof, the maximum diameter of the second portion being substantially equal to that of said cylindrical member, said insertion tool comprising means for forming said rivet forming end into a blind rivet including a base member of substantially the same shape as said preformed rivet head and a forming stem coupled to said base, said forming stem comprising a plurality of aligned forming members having an outer cylindrical profile adapted to be slidably received within the cylindrical member of said blind rivet, said aligned forming members each comprising first and second sections pivotally coupled to one another and having an inner cylindrical aperture along the axis thereof, said cylindrical aperture extending outwardly into a symmetrical cavity uniformly disposed into the inner surfaces of said aligned forming members, said forming stem including means for imposing an outwardly directed radial force on said forming stem, said means being slidably disposed within said forming stem whereby a radial force is imposed on said second portion when said means is withdrawn from said forming stem, the symmetrical cavity disposed into the inner surfaces of said aligned forming members being adapted to receive said means therein.

2. A blind rivet insertion tool as defined in claim 1 wherein said forming stem comprises three aligned forming members, the outer surface of each forming member comprising 120° of circular arc.

3. A blind rivet insertion tool as defined in claim 1 wherein said means for imposing an outwardly directed radial force comprises a cylindrical mandrel having a radially, outwardly extending frusto-conical section adapted to cooperatively engage a portion of said symmetrical cavity whereby said aligned forming members pivot outwardly when the mandrel is slidably withdrawn from said forming stem.

4. A blind rivet insertion tool as defined in claim 1 wherein said expandable forming stem comprises a plurality of aligned forming members having an outer cylindrical profile and adapted to be slidably received within the cylindrical member of said blind rivet, said aligned members each comprising first and second sections pivotally coupled to one another and having an inner cylindrical bore along the axis thereof, said cylindrical bore extending outwardly into a symmetrical frusto-conical cavity uniformly disposed into the inner surface of said aligned forming members, said inner bore being adapted to cooperatively receive said expansion means.

5. A blind rivet insertion tool as defined in claim 4 wherein said expandable forming stem comprises three aligned forming members, the outer surface of each of said forming member comprising 120° of circular arc.

6. a blind rivet insertion tool as defined in claim 5 wherein said expansion means comprises a cylindrical mandrel having an axially aligned outwardly depending frusto-conical section adapted to cooperatively engage a portion of said cylindrical cavity whereby said aligned forming members pivot outwardly when the mandrel is slidably withdrawn from said expandable forming stem.

* * * * *